US006622794B2

(12) United States Patent
Zisk, Jr.

(10) Patent No.: US 6,622,794 B2
(45) Date of Patent: Sep. 23, 2003

(54) SAND SCREEN WITH ACTIVE FLOW CONTROL AND ASSOCIATED METHOD OF USE

(75) Inventor: Edward J. Zisk, Jr., Round Rock, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/054,090

(22) Filed: Jan. 22, 2002

(65) Prior Publication Data

US 2002/0108755 A1 Aug. 15, 2002

Related U.S. Application Data

(60) Provisional application No. 60/264,358, filed on Jan. 26, 2001.

(51) Int. Cl.[7] ..... E21B 34/06; E21B 43/08

(52) U.S. Cl. ..... 166/373; 166/205; 166/66.7

(58) Field of Search ..... 166/369, 373, 166/386, 227, 205, 66.7, 334.1, 334.4

(56) References Cited

U.S. PATENT DOCUMENTS

| | | | | |
|---|---|---|---|---|
| 4,577,691 A | | 3/1986 | Huang et al. | 166/263 |
| 4,619,320 A | * | 10/1986 | Adnyana et al. | 166/66.7 |
| 4,684,947 A | | 8/1987 | Zimmer | 340/858 |
| 4,808,996 A | | 2/1989 | Zimmer | 340/858 |
| 4,821,801 A | | 4/1989 | Van Laar | 166/250 |
| 4,858,691 A | | 8/1989 | Ilfrey et al. | 166/278 |
| 5,203,414 A | * | 4/1993 | Hromas et al. | 166/382 |
| 5,259,452 A | | 11/1993 | Wittrisch | 166/250 |
| 5,346,014 A | * | 9/1994 | Ross | 166/297 |
| 5,377,750 A | * | 1/1995 | Arterbury et al. | 166/205 |
| 5,461,594 A | | 10/1995 | Mougenot et al. | 367/48 |
| 5,476,143 A | * | 12/1995 | Sparlin et al. | 166/233 |
| 5,481,502 A | | 1/1996 | Cretin et al. | 367/77 |
| 5,550,785 A | | 8/1996 | Laurent et al. | 367/25 |
| 5,597,042 A | | 1/1997 | Tubel et al. | 166/250.01 |
| 5,721,538 A | | 2/1998 | Tubel et al. | 340/853.4 |
| 5,873,049 A | | 2/1999 | Bielak et al. | 702/6 |
| 5,896,928 A | * | 4/1999 | Coon | 166/373 |
| 5,906,238 A | * | 5/1999 | Carmody et al. | 166/53 |
| 5,959,547 A | | 9/1999 | Tubel et al. | 340/853.2 |
| 6,012,015 A | | 1/2000 | Tubel | 702/6 |
| 6,220,345 B1 | * | 4/2001 | Jones et al. | 166/51 |
| 6,321,845 B1 | * | 11/2001 | Deaton | 166/363 |
| 6,371,210 B1 | * | 4/2002 | Bode et al. | 166/370 |
| 6,481,494 B1 | * | 11/2002 | Dusterhoft et al. | 166/51 |

FOREIGN PATENT DOCUMENTS

| | | |
|---|---|---|
| GB | 2169018 | 7/1986 |
| GB | 2314866 | 1/1998 |
| GB | 2351748 | 1/2001 |
| GB | 2361017 | 10/2001 |
| NO | 306127 | 9/1999 |

* cited by examiner

*Primary Examiner*—David Bagnell
*Assistant Examiner*—T Shane Bomar
(74) *Attorney, Agent, or Firm*—Madan, Mossman & Sriram, P.C.

(57) ABSTRACT

Apparatus and methods are disclosed for actively controlling the flow of hydrocarbon fluids from a producing formation at the downhole sand screen. A preferred embodiment of the invention provides a fluid flow annulus within the production tube inside of the screen. In a first flow control configuration, fluid passing through the screen is required to flow along the annulus to find a flow aperture into an interior flow bore. A static flow control device within the annulus between the sand screen and a first flow aperture dissipates flow energy by forcing the flow through a restricted area that helically winds about the flow annulus. Dissipation of the flow energy increases the pressure reduction from the screen into the production bore and reduces the flow velocity. In a second flow control configuration, flow control structure within the flow annulus obstructs all flow along the annulus. A third flow control configuration removes all flow restrictions within the flow annulus.

17 Claims, 7 Drawing Sheets

SAND SCREEN WITH ACTIVE FLOW CONTROL AND ASSOCIATED METHOD OF USE

CROSS REFERENCED TO RELATED APPLICATIONS

This application claims priority from the USPTO provisional patent application entitled "Sand Screen with Active Flow Control" by Edward Joseph Zisk, Jr., filed on Jan. 26, 2001, serial No. 60/264,358.

BACKGROUND OF THE INVENTION

1. Field of the Invention

The present invention relates to the art of well completion methods and equipment for the production of hydrocarbon fluids. More particularly, the invention relates to methods and apparatus for downhole regulation of hydrocarbon fluid production rates.

2. Description of Related Art

Bottom hole well tools are exposed to extremely abrasive operating conditions. As hydrocarbon fluid is released from the naturally occurring in situ formation, sand, rock and other abrasive particles are drawn with it. In deeper wells where the in situ pressures are extremely high, the production pressure drop between the formation and the flow bore of the production tube is correspondingly high. Such high pressure differentials in the presence of a highly abrasive fluid rapidly erodes the production control tools. Fluid velocity through and over the tool surfaces, elements and apertures is an exponential function of the pressure differential drive. Hence, high pressure differentials translate to high fluid velocities. High velocity fluids entrained with abrasives translates to high rates of erosion, wear and failure.

Earth formation pressures and fluid production are not, however, fixed properties. Both of these properties change over time. Moreover, the changes are not necessarily linear or in predictable directions. The changes may be abrupt, irregular and/or fluctuating. In cases of an elongated production zone, often horizontal, the production properties may change in one section of the producing zone differently than those in another section of the same producing zone.

Although downhole tools for limiting the production rate of a production zone are known to the prior art, such tools have a fixed configuration. Production flow rate adjustments are usually made at the surface. Downhole flow rate adjustment is accomplished by removing the production tools from the well bore and replacing a first fixed flow rate tool with a second fixed flow rate tool of different capacity.

It is, therefore, an object of the present invention to provide active flow control, from the surface, over production from gravel pack installations through sand control screens down to an individual screen.

Another object of the invention is provision of means to regulate the inflow of fluids from a long, horizontal petroleum reservoir to maximize production.

Also an object of the present invention is provision of means to terminate production flow from a production screen or to divert flow from one screen to another within the screen assembly.

A further object of the invention is provision of means to adjust the production flow rate of a well.

SUMMARY OF THE INVENTION

These and other objects of the invention are served by a tool that is associated with a production sand screen to channel the screened production flow through a flow control zone. Within the flow control zone is a static flow control device that reduces the fluid pressure differential over an extended length of flow restrictive channel. At either end of the flow control device are transverse flow apertures disposed between the flow control zone and the internal flow bore of the primary production tube.

The apertures are flow controlled as either opened or closed completely. This operational set allows three flow states. When the apertures upstream of the flow control device are closed and those downstream are open, all production flow from the associated screen must pass through the flow control device. In doing so, the flow stream is required to follow a long, helical path. Traversal of the flow control device dissipates the pressure of state within the fluid thereby reducing the pressure differential across the production tool. The energy potential of the pressure is converted to heat.

When apertures upstream of the flow control device are open and those downstream are closed, production flow is shunted directly from the flow control zone into the internal flow bore of the primary production tube. This operational state permits the particular tool to run "open choke" but not necessarily all tools in the formation.

The third flow state closes both apertures to terminate all production flow from the associated screen.

A preferred embodiment of the invention provides a cylindrical tool mandrel within the internal bore of a production tube that forms an annular flow channel along the tube axis. Axially displaced from the screen inflow area, is a circumferential band of longitudinal stator columns that span radially across the flow channel annulus to funnel the annulus flow through gates between the stator columns. Further displaced axially along the flow channel annulus is a helically wound wall that also spans radially across the flow channel annulus. This helically wound wall is one embodiment of a static flow control device.

Two sets of flow apertures through the mandrel wall section link the annular flow channel with the internal bore of the production tube. A first aperture set is positioned axially displaced from the static flow control device opposite from the band of stator columns. A second aperture set is positioned axially displaced from the band of stator columns opposite from the flow control device. An axially slideable ring substantially encompasses the mandrel at an axial location adjacent to the stator columns opposite from the static flow control device. The ring is axially displaced by one or more hydraulic cylinders. From one annular edge of the ring projects a number of gate plugs. The number of plugs corresponds to the number of gates. The gate plugs overlie the second set of flow apertures at all positions of axial displacement but one.

At a first, axially stroked extreme position of the ring, the second flow aperture set is open to facilitate direct and unrestricted flow of production flow from the channel annulus into the internal bore.

At an intermediate axial position of the ring, the plugs close the gates between the stator columns thereby blocking flow to the first flow aperture set. Also at this intermediate setting, the gates block flow through the second set of apertures by their lapped, overlay location. Consequently, at the intermediate setting, no flow from the channel annulus is admitted into the inner bore.

At a second axial extreme position, the plugs are withdrawn from the gates to allow flow through the static flow control device and into the first set of flow apertures.

Hoewever, at the second axial extreme position the plugs continue to block flow through the second set of flow apertures. Consequently, the flow stream is required to traverse the static flow control device to reach the inner production tube bore.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements through the several figures. Briefly.

DESCRIPTION OF THE PREFERRED EMBODIMENTS

Figure 1:
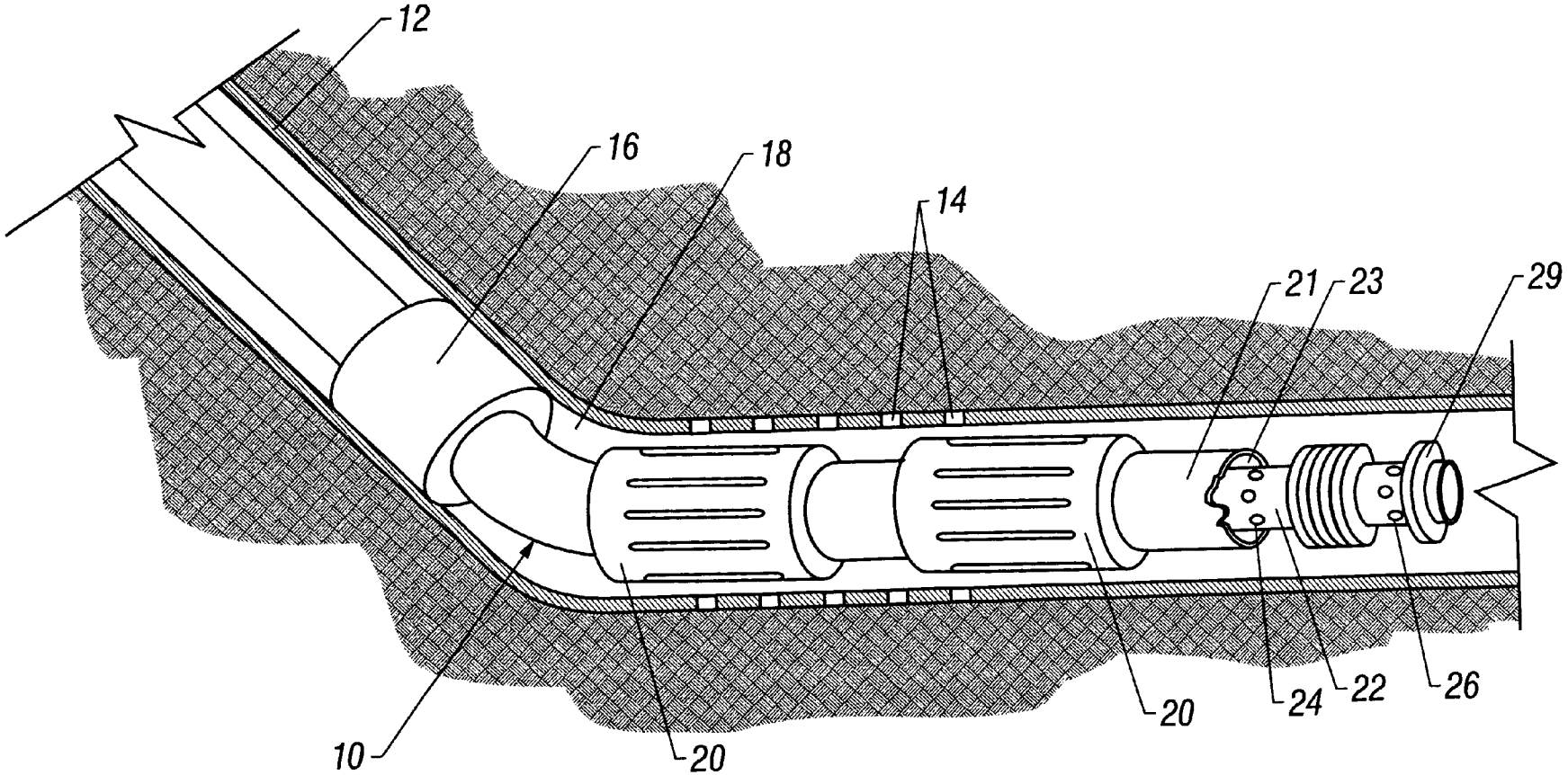
FIG. 1 is an environmental schematic of the invention.

With respect to the environmental schematic of FIG. 1, a production tube 10 is positioned within a wellbore casing 12 to provide a continuous flow conduit to the surface for a flow of fluids extracted from a subterranean earth formation. Along a formation fluid production zone, the casing is perforated by apertures 14 for facilitation of formation fluid flow into an outer production annulus 18 between the interior wall of the casing and the exterior wall of the production tube. Longitudinally, the production annulus 18 may be delimited by an outer packer 16.

Below the outer packer 16, the production tube 10 includes one or more sand screens 20 linked by flow control housings 21. Internally of the screens and flow control housings is a flow control mandrel 22. A flow control annulus 23 is accommodated between the interior walls of the flow control housings 21 and the exterior walls of the mandrel 22. The continuity of the flow control annulus 23 may be interrupted between sand screens 20 by an inner packer 29.

Figure 2:
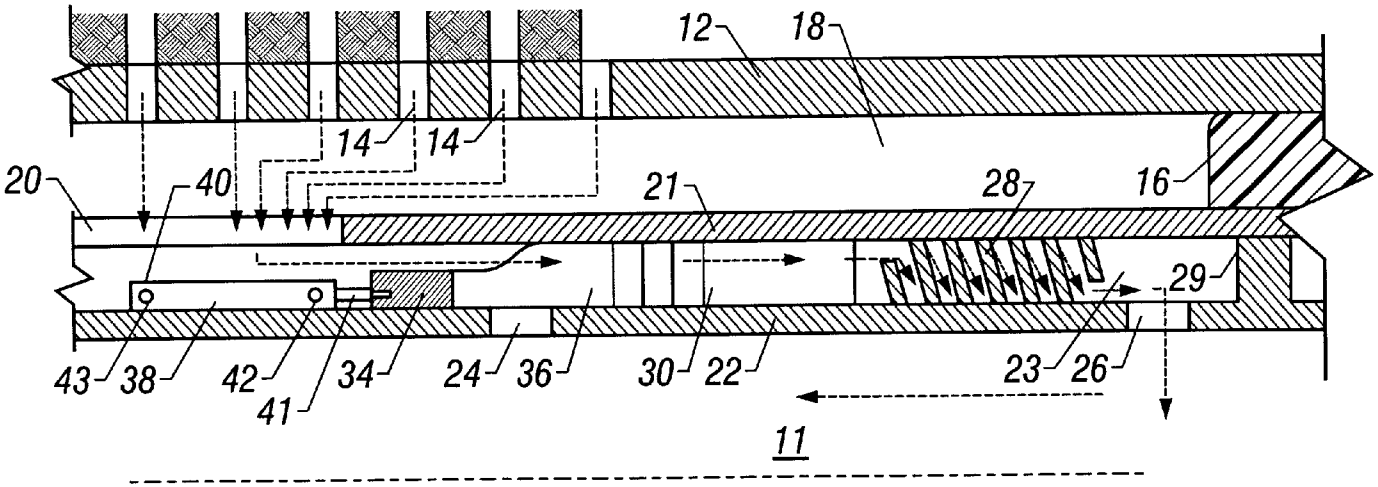
FIG. 2 is a cross-sectional view of the invention in a flow restrictive setting.
Figure 3:
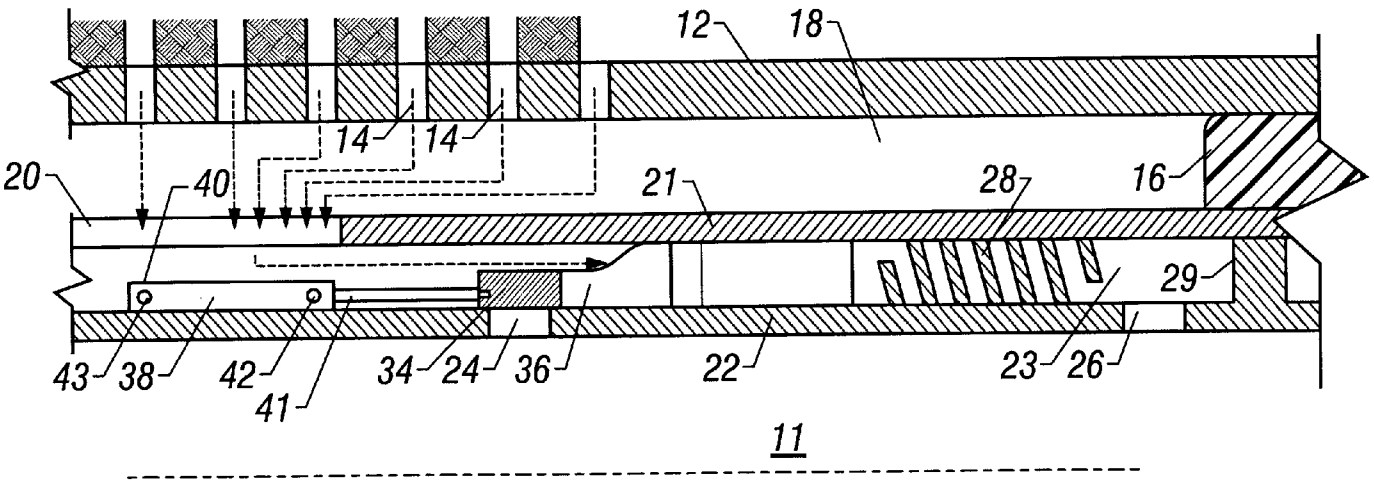
FIG. 3 is a cross-sectional view of the invention in a flow obstructing setting.
Figure 4:
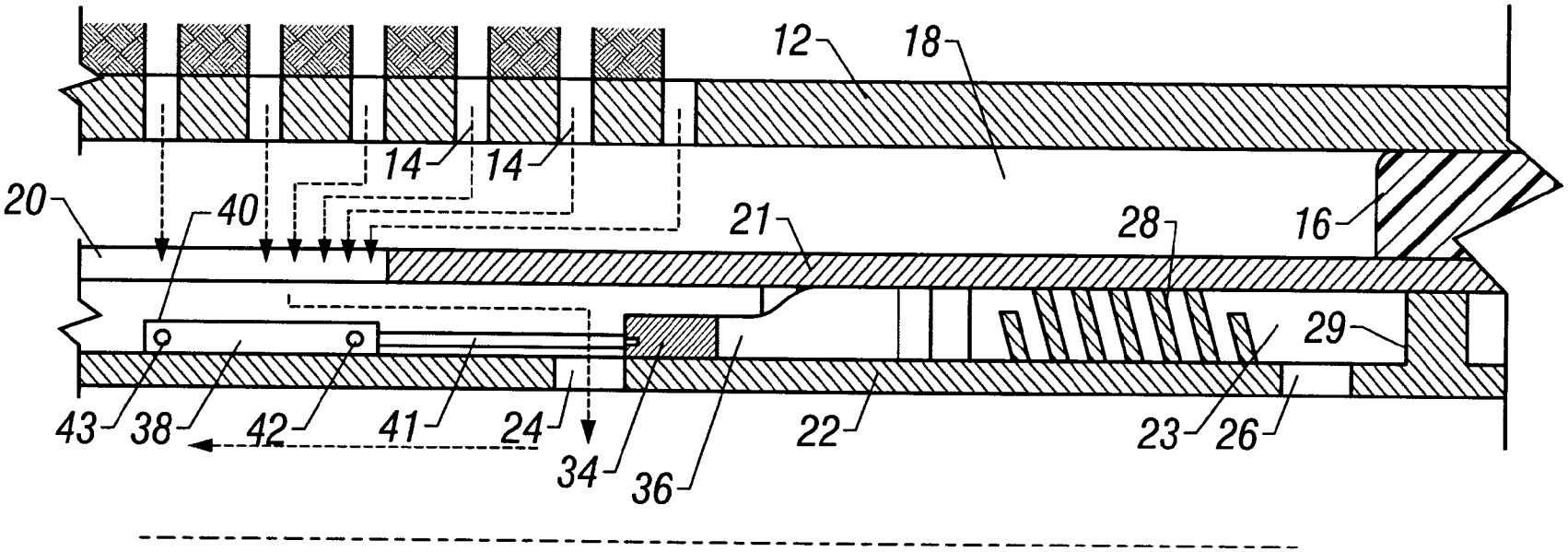
FIG. 4 is a cross-sectional view of the invention in a free-flow setting.
Figure 5:
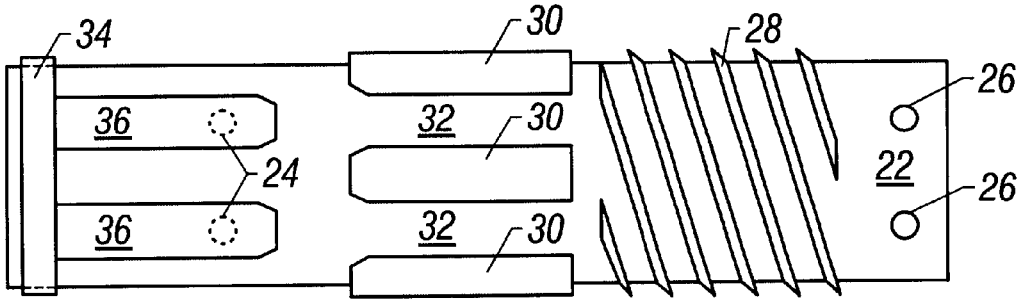
FIG. 5 is a plan view of the invention mandrel in the restrictive flow setting.

Referring now to the partial cross-section of FIG. 2 and the schematic plan of FIG. 5, it is seen that the wall of mandrel 22 is penetrated by two circumferential sets of flow apertures 24 and 26. Between the apertures 24 and 26, the outer mandrel surface is profiled by surfaces that extend radially out to juxtaposition with the interior surface of the housing thereby substantially confining all fluid flow along the flow control annulus 23.

A first exterior profile on the flow control mandrel 22 is a circumferential band of substantially uniformly spaced stator columns 30. Between the stator columns 30 are flow gates 32. A second exterior profile on the flow control mandrel 22 is a static flow control device 28 comprising a helically wound channel between parallel walls.

Proximate of the first circumferential set of flow apertures 24 is a circumferential set of gate plugs 36 extending from one edge of a base ring 34. The opposite base ring 34 edge is attached to one or more hydraulic, for example, struts 38. Representatively, a strut 38 may comprise a cylinder 40 secured to the surface of mandrel 22 and a piston rod 41 secured to the opposite edge of the base ring 34. The rod 41 may be extended axially from the cylinder 40 to axially reposition the base ring 34 and gate plugs 36 by manipulations of pressurized hydraulic fluid in one or two hydraulic fluid conduits 42 and 43. Extensions of the conduits 42 and 43 to the surface enable these manipulations from the surface if required. Downhole hydraulic fluid power control may also be accomplished by numerous other means and methods known to the active practitioners of the art.

Figure 6:
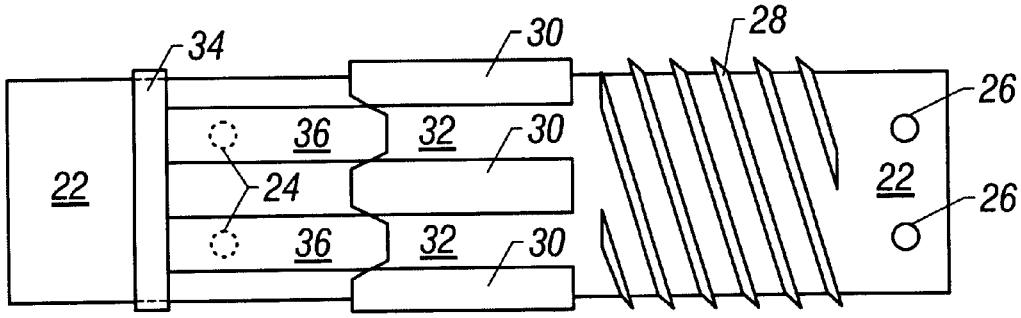
FIG. 6 is a plan view of the invention mandrel in a flow obstructing setting.
Figure 7:
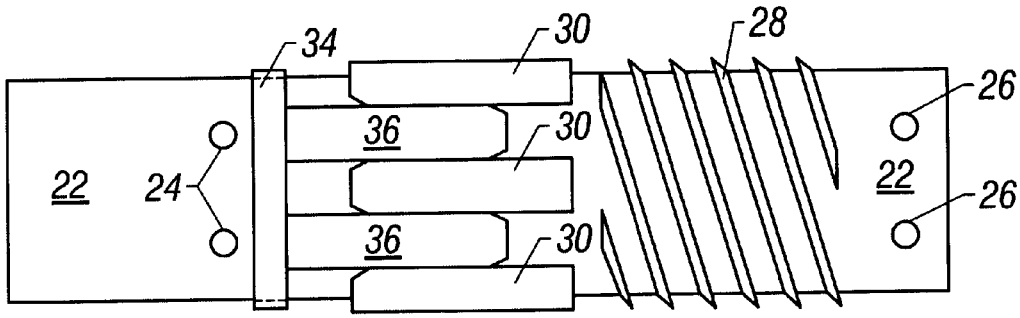
FIG. 7 is a plan view of the invention mandrel in a free-flow setting.

As may be observes from a comparison of FIGS. 5, 6, and 7, the rod 41 is stroked to provide the base ring 34 and projecting gate plugs 36 an intermediate position (FIG. 6) between two extreme positions (FIGS. 5 and 7). At the FIG. 5 position, production flow may travel along the control annulus 23, around the gate plugs 36, through the gates 32 between stator columns 30, and along the helically wound flow channel of the static control device 28 into the apertures 26. From the apertures 26, the fluid enters the inner bore 11 of the production tube to be lifted or driven by expanding gas to the surface. To be noted from FIG. 5 is the overlaid relationship of the apertures 24 by the gate plugs 36 thereby effectively blocking fluid flow into the apertures 24.

When the gate plugs 36 are shifted to the intermediate position shown by FIG. 6, the plugs 36 fill the flow channel space 32 between the stator columns 30 thereby blocking flow into the static flow control device 28. Consequently, no flow reaches the apertures 26 for flow into the inner bore 11. Moreover, gate plugs 36 continue to overlie the aperture set 24 and block fluid flow therethrough.

FIG. 7 illustrates the alternative extreme position whereat the gate plugs 36 enter the gates 32 fully thereby continuing the blockage of flow into the apertures 26. However, as the gate plugs 36 move deeper into the gates 32, the apertures 24 are uncovered. At this arrangement, only a minimum of flow resistance is imposed as the production flow stream finds its way to the surface.

Figure 8:
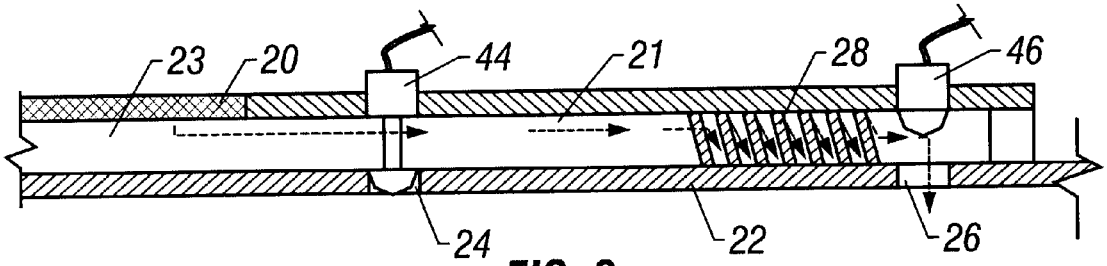
FIG. 8 is a solenoid valve controlled embodiment of the invention.

The alternative embodiment of the invention depicted by FIG. 8 controls the opening and closing of apertures 24 and 26 with electrically actuated solenoid valves 44 and 46. For unrestricted flow, valves 44 would be opened and valves 46 closed. For maximum flow resistance, Valves 44 would be closed and valves 46 opened to force the production flow through the static flow restriction device 28. For zero flow, of course, both valves 44 and 46 are closed.

Figure 9A:
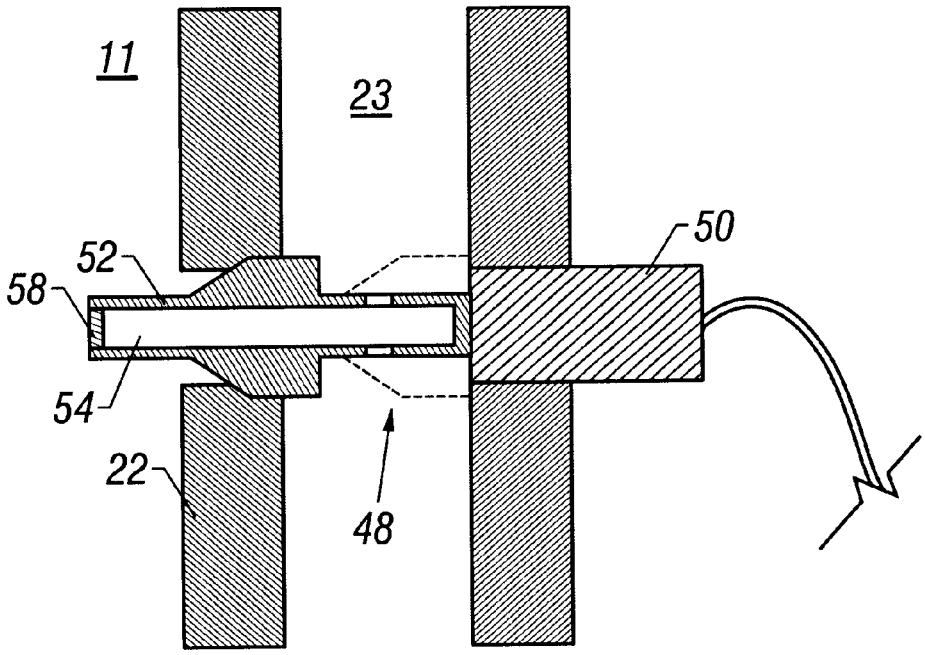
FIG. 9A is a cross-sectional view of a special case solenoid valve pintle in a normal operating mode.
Figure 9B:
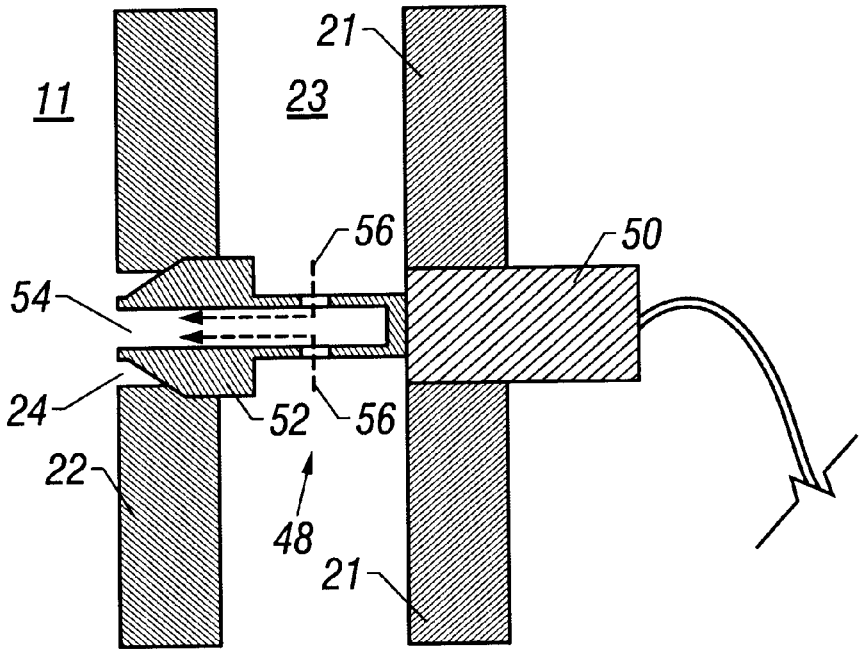
FIG. 9B is a cross-sectional view of a special case solenoid valve pintle in a normal operating mode.

As a permutation of the FIG. 8 embodiment, FIGS. 9A and 9B illustrate a solenoid valve 48 having an electrically energized winding 50 secured in the housing 21 for selectively translating a pintle 52 into or out of a flow aperture 24 or 26. Distinctively, the pintle 52 is centrally hollow. The hollow core 54 of the pintle stem is closed by plug 58 at the end that penetrates into the inner flow bore 11. However, the hollow core is open to the control flow annulus 23 by apertures 56 when the pintle 52 is at the closed aperture 24 position. In the event of power or control failure of a nature that prevents a desired opening of a closed valve 48, a restricted by-pass flow may be obtained by deployment of a shear dart from the surface along the inner bore 11 to mechanically break the end of the pintle stem and expose the hollow core 54.

Figure 11A:
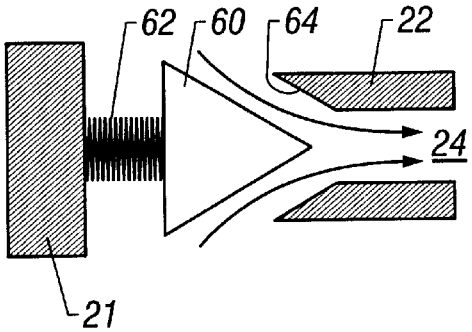
FIG. 11A is a production valve control system responsive to a shape memory alloy driver to open a production flow transfer aperture.
Figure 11B:
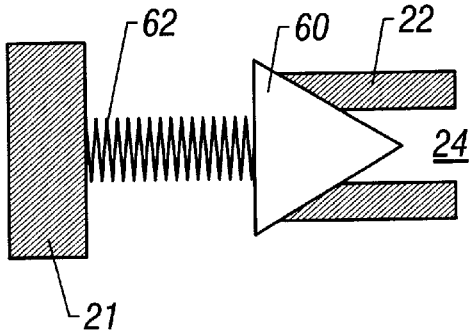
FIG. 11B is a production valve control system responsive to a shape memory alloy driver to close a production flow transfer aperture; and, FIGS. 12A through 12D illustrate the operational sequence of an automatic, thermally controlled valve pintle.
Figure 12A:
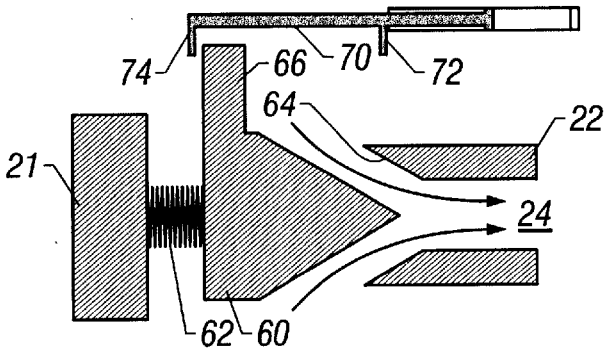

As the flow of the production fluid transfers energy to the flow control equipment, frictional heat is generated. Consequently, the equipment temperature bears a functional relationship to the production flow rate. Based on the fact that operating temperatures of flow control devices change as a function of flow rates, automated downhole control of such devices may be accomplished with valves that respond operationally to the temperature changes. FIGS.11A and 11B illustrate one embodiment of this principle wherein a valve pintle element 60 is operatively driven by a shape memory alloy 62 into cooperative engagement with a valve seat 64 to directly control production flow through an aperture 24. FIG.12A schematically illustrates the valve elements in a production flow condition wherein the flow rate through the flow aperture 24 is insufficient to generate heat at a rate that is sufficient to expand the shape memory alloy valve driver 62. In contrast, FIG.11B schematically illustrates a non-flow condition wherein the shape memory alloy driver 62 has expanded due to excessive heating and pushed the pintle 60 into engagement with the aperture 24 seat 64.

Figure 12B:
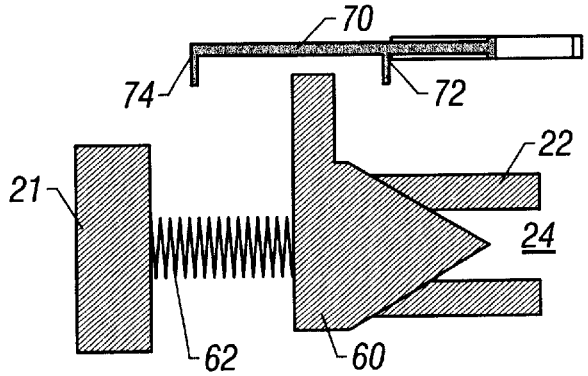

The invention embodiment of FIGS. 12A–12D modifies the foregoing control structure further with a mechanically controlled override. In this design, the valve pintle 60 includes, for example, an engagement tab 66 that cooperates with shift fingers 72 and 74 that depend from a selectively stroked hydraulic strut. FIG. 12A schematically illustrates the production flow condition in which the shape memory alloy driver 62 is contracted and the pintle 60 is withdrawn from the valve seat 64. The strut 70 is at an intermediate position with the shift finger 74 in close proximity with the engagement tab 66. FIG. 12B schematically illustrates a condition change wherein flow generated heat has expanded the alloy driver 62 and caused the pintle 60 to be translated into closure contact with the valve seat 64.

Figure 12C:
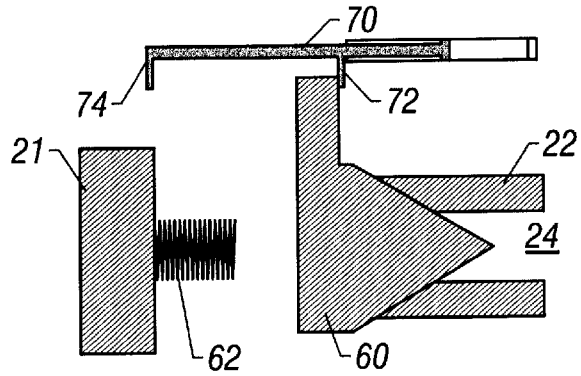
Figure 12D:
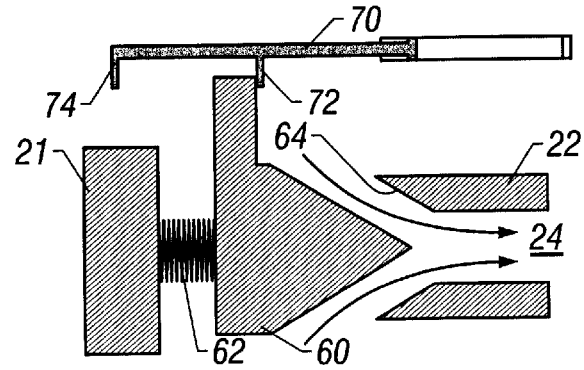

Represented by FIG. 12C is a disfunction condition wherein the alloy driver 62 has cooled and contracted but the pintle 60 has not drawn away from the seat 64 to open the aperture 24. FIG. 12D schematically illustrates the override of the shape memory alloy 62 with an engagement of the pintle tab 66 by the strut finger 72 to forceably push the pintle 60 away from the valve seat 64.

Figure 10A:
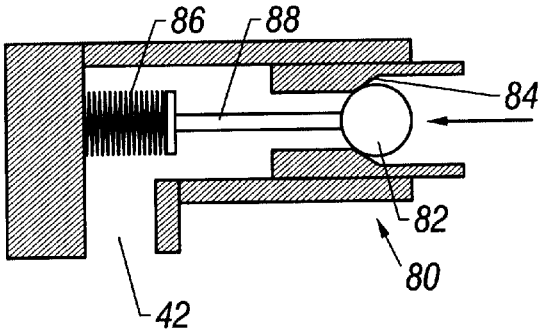
FIG. 10A is a hydraulic control schematic in the hydraulic fluid flow blocking mode due to production flow temperature.
Figure 10B:
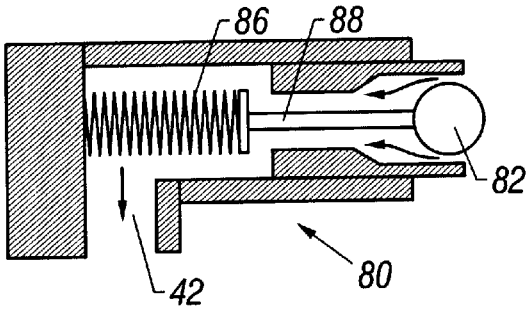
FIG. 10B is a hydraulic control schematic in the hydraulic fluid flow open mode due to production flow temperature.

The inventive concepts represented by FIGS. 10A and 10B apply the concepts of automatic flow regulation with shape memory alloy control elements to the hydraulic control lines 42 and/or 43 in the FIG. 2 embodiment. FIG. 10A represents a check valve control 80 in the hydraulic strut power line 42. A ball closure element 82 is pressure differentially biased against the valve seat 84 to block flow through the conduit 42 into the strut 38. The closure condition prevails while the shape memory alloy driver 86 is cool and contracted. When the flow control elements are sufficiently heated by excessive flow velocity, the memory alloy driver 86 expands against the disengagement probe 88 to push the ball 82 off the seat 84 and allow hydraulic flow into the strut 38. Resultantly, the strut rod 41 and gate plug 36 are displaced in a direction to restrict or terminate the excessive flow.

Modifications and improvements may be made to these inventive concepts without departing from the scope of the invention. The specific embodiments shown and described herein are merely illustrative of the invention and should not be interpreted as limiting the scope of the invention or construction of the claims appended hereto.

What is claimed is:

1. A method of regulating the flow of hydrocarbon fluid from a producing zone into a production well, said method comprising the steps of:

a. providing a fluid production tube in a wellbore having a formation fluid production zone, said production tube having a production flow bore therein;

b. providing an intermediate fluid flow channel within said production tube between said production zone and said production flow bore;

c. providing a static flow restriction within said intermediate channel;

d. providing a first flow aperture between said intermediate channel and said production flow bore downstream of said flow restriction;

e. providing a second flow aperture between said intermediate channel and said production flow bore upstream of said flow restriction; and, f. selectively obstructing fluid flow through either or both of said flow apertures.

2. A method as described by claim 1 wherein said flow apertures are selectively opened and closed.

3. A method as described by claim 1 wherein fluid flow through said first aperture is obstructed by a selective obstruction of flow through said flow restriction.

4. A well tool for regulating the flow rate of fluid from an earth producing zone, said tool comprising:

a. a well fluid production tube having a production flow channel therein and a production fluid flow screen for passing fluid from said producing zone into said production flow channel;

b. an intermediate flow channel between said flow screen and said production flow channel;

c. a static flow restriction in said intermediate channel;

d. a first fluid flow aperture between said intermediate flow channel and said production flow channel disposed downstream of said static flow restriction;

e. a second fluid flow aperture between said intermediate flow channel and said production flow channel disposed upstream of said static flow restriction; and f. a selectively positioned flow obstruction for substantially preventing fluid flow through either or both of said flow apertures.

5. A well tool as described by claim 4 wherein said selectively positioned obstruction is driven by a shape memory alloy.

6. A well tool as described by claim 4 wherein said selectively positioned obstruction is a solenoid valve operator respective to said flow apertures.

7. A well tool as described by claim 6 wherein said valve operator comprises a flow by-pass element.

8. A well tool as described by claim 7 wherein said by-pass element comprises a valve stem conduit having an open entry aperture in said intermediate flow channel and a plugged exit aperture in said production flow channel.

9. A well tool as described by claim 4 wherein said flow obstruction comprises a fluid flow gate within said intermediate flow channel for obstructing fluid flow into said flow restriction.

10. A well tool as described by claim 9 wherein fluid flow through said fluid flow gate is controlled by a selectively positioned plug.

11. A well tool as described by claim 10 wherein said selectively positioned plug also obstructs fluid flow through said second flow aperture.

12. A method of regulating the flow of production fluid from a fluid producing zone into a production conduit comprising the steps of:

(a) providing first and second fluid flow routes for production fluid from a producing zone into a production conduit;

(b) providing greater resistance to flow along said second flow route relative to flow along said first flow route; and, (c) providing a first selectively engaged flow obstruction along said first flow route.

13. A method as described by claim 12 further providing a second selectively engaged flow obstruction along said second flow route.

14. A method as described by claim 12 wherein said first and second flow routes extend from an intermediate fluid flow channel between said fluid producing zone and said production conduit.

15. A method as described by claim 12 wherein said first flow obstruction is manually engaged.

16. A method as described by claim 12 wherein said first flow obstruction is automatically engaged.

17. A method as described by claim 12 wherein said first flow obstruction is automatically engaged as a function of a production fluid flow rate.

* * * * *